US006636411B1

(12) United States Patent
Noll

(10) Patent No.: US 6,636,411 B1
(45) Date of Patent: Oct. 21, 2003

(54) GAS-PURGED IONIZERS AND METHODS OF ACHIEVING STATIC NEUTRALIZATION THEREOF

(75) Inventor: Charles G. Noll, Sellersville, PA (US)

(73) Assignee: Illinois Toolworks, Inc., Glenview, IL (US)

( * ) Notice: Subject to any disclaimer, the term of this patent is extended or adjusted under 35 U.S.C. 154(b) by 0 days.

(21) Appl. No.: 09/868,788

(22) PCT Filed: Dec. 22, 1999

(86) PCT No.: PCT/US99/30495

§ 371 (c)(1),
(2), (4) Date: Oct. 30, 2001

(87) PCT Pub. No.: WO00/38484

PCT Pub. Date: Jun. 29, 2000

Related U.S. Application Data

(60) Provisional application No. 60/113,684, filed on Dec. 22, 1998, and provisional application No. 60/113,685, filed on Dec. 22, 1998.

(51) Int. Cl.[7] ..... H05F 3/06

(52) U.S. Cl. ..... 361/213; 307/91; 361/212; 361/225; 361/226; 361/229

(58) Field of Search ..... 307/91; 361/212, 361/213, 225, 226, 229

(56) References Cited

U.S. PATENT DOCUMENTS 3,879,183 A * 4/1975 Carlson ..... 65/30
5,750,011 A * 5/1998 Ohmi et al. ..... 204/164

OTHER PUBLICATIONS

Hiziroglu et al.; "Breakdown Voltages in SF/Sub 6/+ Argon Mixtures Under Nonuniform Electrostatic Fields"; IEEE 1997 Annual Report. Conference On Electrical Insulation and Dielectric Phenomena.

* cited by examiner

*Primary Examiner*—Stephen W. Jackson
*Assistant Examiner*—Robert L. DeBeradinis
(74) *Attorney, Agent, or Firm*—Lowe Hauptman Gilman & Berner LLP

(57) ABSTRACT

A small quantity of electron attaching gas is introduced into the corona region of an electrical ionizer to stabilize the corona in the otherwise electron non-attaching nitrogen gas. The corona region is closely localized at emitter points so the quantity of electron attaching gas is very small. Clean-dry-air is preferably used as the purge gas but other gases such as oxygen and carbon dioxide may be used. The small quantity of electron attaching gas may be introduced either through a hollow needle emitter or an external purge gas (sleeve about the needle, or by using a gas purge nozzle).

20 Claims, 9 Drawing Sheets

GAS-PURGED IONIZERS AND METHODS OF ACHIEVING STATIC NEUTRALIZATION THEREOF

RELATED APPLICATIONS

The present application claims priority of U.S. Provisional Application Ser. No. 60/113,684, filed Dec. 22, 1999, entitled "Static Neutralizer for Thermal Cycling Chamber" and Provisional Application Ser. No. 60/113,685, filed Dec. 22, 1999, entitled "Gas-Purged Ionizer", the disclosures of which are incorporated by reference herein in their entirety.

TECHNICAL FIELD

The present invention relates generally to electrical ionizers that produce stable charge-carrier production in gases with varying concentrations of electron attaching components. More particularly, the invention relates to ionizers suited for production test environments of semiconductor devices and component handlers and other environments that might be rendered inert by nitrogen and noble gases.

BACKGROUND ART

In semiconductor component testing, the temperature is normally closely controlled at selected values in the range from −60° C. and +160° C. Cooling is accomplished by the introduction of liquid nitrogen and its cold vapors into a test chamber at ambient pressure. Nitrogen gas which evolves from evaporative cooling is not electron attaching and, as a result, has a profound effect on electrical ionizers both in stability and generation of EMI/RFI.

A primary object of this invention is to produce a balanced amount of negative and positive charge carriers for charge neutralization by injecting a small amount of an electron attaching gas into an electrical ionizer to restore and stabilize negative ion production.

Charge imbalances in semiconductor testing equipment are known to result in electrical discharges that will damage the devices and components being tested.

Accordingly, another object of this invention is to eliminate such charge imbalances in environments where conventional electrical ionizers fail or are difficult to control.

Conventional electrical, x-ray, ultraviolet, and nuclear (radioactive) static eliminators have been used in this application. It has been found that conventional electrical static eliminators were unreliable and those based on ionizing radiation are difficult to control and unacceptable in some markets by their hazardous nature or burdened by licensing requirements.

Ionizers for static eliminators provide positive and negative charges having the mobility needed to be drawn to static (stationary or fixed) electrical charges on surfaces or charged floating conductors. The production of charge carriers is critical to static elimination. Ionization can be achieved by means of ionizing radiation (primarily radioactive, x-ray, and ultraviolet sources) and electrical corona.

The primary processes in ion production are ionization itself and electron attachment. In the ionization process, electrons are separated from a neutral atom or molecule. This action produces positive ions and free electrons.

In a positive corona the ionization process takes place near an electrode region with a positive polarity (a deficiency of electrons). The free electrons that are produced in the ionization process are drawn to this corona electrode (either as free electrons or attached as negative ions). The positive ions have relatively low mobility when compared to the electrons. The positive ions become available for static elimination by providing a gaseous ion current of charge carriers. They also stabilize the ionization process by providing a buffering electric field in the corona region. This stability is aside from the many underlying corona fluctuations and phenomena known for such corona.

Ionization proceeds by similar methods with negative corona. However, the free electrons drift away from the corona electrode at high speed—free electrons typically have a mobility 100–1000 times those of ions. The positive ions that are produced in negative polarity corona are drawn to the nearby negatively charged corona electrode. In order for the corona to be stabilized and for negative ions to be made available for neutralization, the free electrons must attach to neutral atoms or molecules to form negative ions. It is considered known in the prior art that unless only negative charge is to be neutralized, the successful operation of an electrical static eliminator requires an ionizable gas and one that is electron attaching.

High purity nitrogen and the noble gases are not electron attaching. The present invention offers methods to achieve balance in gases with compositions that are dominated by electron non-attaching components, and in chambers with uncontrolled variability of mixtures of electron attaching and non-attaching gases. The present invention is not limited to the case where nitrogen is evaporated to cool component handlers, but is best used in environments where electrical corona is affected by electron non-attaching gases, i.e., gases with large differences in positive and negative carrier mobilities.

The present invention provides low-cost static neutralization in gases where the mobility of corona generated positive and negative carrier species differ greatly or change over time. The stability is achieved by the injection of a small quantity of electron attaching gas, such as air, oxygen, or carbon dioxide, in close proximity to the corona electrode.

The use of air for purging an ionizer has been contemplated for other purposes. R. Mueller, et al. (U.S. Pat. No. 3,111,605) describes a directly coupled static bar with needles centered in orifices. The casing of the static bar is pressurized with air that escapes through the annular spaces around the needles. The bar is intended for use in hazardous areas, where the air is used to keep ignitable vapors away from the ionizing electrodes. Similar inventions were patented by others (see, e.g., Can. Pat. No. 856,917 and W. Ger. Pat. No. 885,450). The Canadian patent was preceded by prior art attempts including extended range (blower-like) applications and blow-off of particles. Others have also considered such externally purged designs for hazardous area use.

One prior effort involves the introduction of a static bar with hollow emitters for extended range use. Another effort used nitrogen-purged ionizing nozzles in a rinser/dryer to control static charge on semiconductor wafers (U.S. Pat. No. 4,132,567). This effort was not successful as a result of instabilities developed in the ionizer when used in nitrogen environments.

U.S. Pat. No. 5,116,583 discloses an air-purged emitter for controlling particle generation in clean rooms. Moisture in air is known to form particulate contaminants when exposed to corona discharge. In the '583 patent, nitrogen, argon, and helium are identified as purge gases. The primary use of the invention in the '583 patent is with dc ionizers. The '583 patent does not recognize the role of electron non-attaching gases in ionizer design and a method of gas injection to achieve ion balance.

U.S. Pat. No. 5,550,703 discloses a particle-free ionization bar with high and low pressure plenums to distribute gases to the emitters. The velocity of gases was then matched to maintain uniform flow with that of superficial flow within the clean room. A need for balanced ionization was identified, but provisions were not incorporated into the device disclosed in the '703 patent to achieve this goal; in other words, no mention is made for the special requirements to achieve balance in electron non-attaching purge gases. Finally, U.S. Pat. No. 5,847,917 describes the use of high velocity gases around emitters to render them contaminant free.

Ionizers based upon electrical corona are basically of three types: direct-coupled alternating current (ac), capacitively-coupled alternating current (ac), and direct current (dc). The dc ionizers can be operated with continuous or pulsed high voltage on the corona electrodes. Ionizers of the ac variety are desirable because the same emitters are used for both positive-and negative-polarity ion generation; thereby, a size reduction is achieved. Also, both polarity carriers are produced at the same distance from the object to be neutralized, and at the same point in space yielding better mixing of ions with the gas stream. Direct current ionizers offer greater control in ion generation and typically have separate positive and negative corona emitters. The present invention is operable for both ac and dc ionizers.

The instability of alternating-current (ac) corona in nitrogen environments provides the most direct evidence of the problems related to gases with largely-different positive and negative carrier mobilities. In ac corona each emitter electrode is periodically driven with positive and negative polarity voltages. Positive ions are produced on the positive polarity part of the voltage cycle and free electrons are produced on the negative voltage cycle. The free electron current is very high and limits the peak ac voltage before sparkover. When the emitter is directly connected to the high voltage source the peak voltage is so limited that positive ion generation is unsatisfactory and, at best, a negative bias is given to objects intended to receive static elimination. The use of capacitively-or resistively-coupled emitters in ac ionizers, as disclosed in one embodiment of the present invention, limits the free electron current and offers some stability to the ionizers. The injection of electron attaching gases will stabilize resistor-, capacitor-, and directly-coupled corona ionizers.

When current limiting is present in an ac ionizer, it is observed that a negative bias remains at the objects to be neutralized. This imbalance is particularly noticeable when $N_2$ is used to convey the positive (ion) and negative (free electron) carriers to the charged objects. The resulting bias voltage is attributed to the large difference in the carrier mobilities or diffusivities. This effect is independent of the ionizer instabilities and imbalances mentioned above and has been observed by others (H. Inaba, et al., IEEE Trans. Semicond. Mfg., 5(4), 359–67, (1992)).

Overcoming this negative bias voltage is another object of the invention.

The negative bias and instability in electron non-attaching gases is also seen with dc ionizers. It can be eliminated by the method of this invention.

DISCLOSURE OF THE INVENTION

The primary goal of this invention is to stabilize an electrical ionizer against fluctuations in the electron attaching component of the gas around the emitter. This method of operation is intended for use in test chambers for finished semiconductor devices and components, where the introduction of air in small quantities is permitted.

In accordance with the present invention, the introduction of a small quantity of electron attaching gas into the corona region of an electrical ionizer is found to stabilize the corona in the otherwise electron non-attaching nitrogen gas. This corona region is closely localized at emitter points, so the quantity of electron attaching gas is very small. In the present invention, clean-dry-air is most preferably used for this purge gas. Gases, such as oxygen and carbon dioxide, can be used in other applications. The small quantity of electron attaching gas may be introduced either through a hollow-needle emitter (syringe) or an external purge gas (sleeve about the needle, or by using a gas-purged nozzle). Simply introducing an uncontrolled flow of chamber gases (containing residual air) over the needles has not been shown adequate for the application, since it would require a large amount of dry air at temperatures as low as −60 C.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The invention can be understood through consideration of the following drawings.

BEST MODE FOR CARRYING OUT THE INVENTION

Figure 1A:
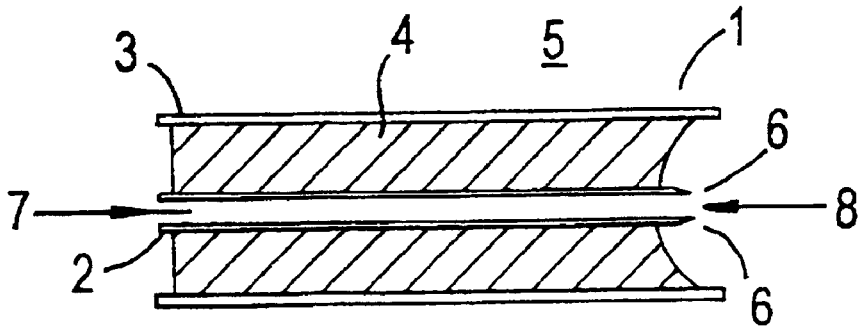
FIG. 1*a* is a partly sectional, partly schematic representation of a generic gas-purged, hollow-electrode arrangement constructed in accordance with the principles of the present invention.
Figure 1B:
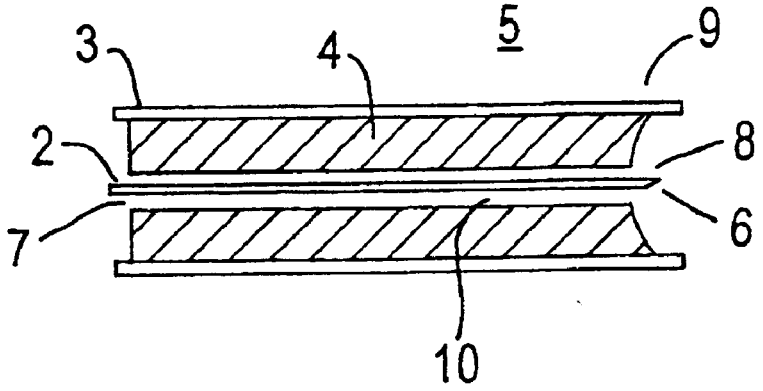
FIG. 1*b* is a generic gas-purged, shielded-electrode arrangement constructed in accordance with the principles of the present invention.

The present invention circumvents the deficiencies of conventional electrical ionizers as described above by introducing a small quantity of electron attaching gas into the corona region of an ac or dc ionizer. FIGS. 1*a* and 1*b* illustrate the generic arrangements for gas injection through a hollow emitter electrode and about an emitter in a cavity, respectively. The elements of these ionizers are similar.

FIG. 1*a* shows a cross-sectional view of an electrode assembly 1 for gas injection through the corona emitter. The assembly may be tubular or linear. A potential difference (ac, dc or pulsed voltage) is applied between a conductive or semiconductive corona electrode 2 and a conductive or semiconductive counterelectrode 3. The space between electrodes 2 and 3 is filled with insulating material 4, which may include gases and solid materials. The ionizer is placed in a gaseous environment 5. The potential difference between the electrodes 2, 3 results in large electrical stresses near sharp edges, such as 6. Electrical corona, the localized electrical breakdown of gases, is closely localized at emitter points, such as 6, and is the source of gaseous ions from ionizers. When the region 6 is exposed to an environment 5 that does not have electron attaching components, free electrons are produced and no negative ions are formed. The absence of negative ions results in unstable operation of the ionizer. By injection of a small quantity of electron attaching gas 7, such as air, oxygen, or carbon dioxide, to the emitter region 6, negative ions form and stabilize the corona. In the hollow-emitter electrode, the injected gas exits at the emitter 8.

The elements of the needle-cavity assembly 9 in FIG. 1*b* are nearly the same as for the hollow-emitter assembly 1 in FIG. 1*a*. In this case the gas injection channel 10 surrounds the corona electrode 2 and the exiting gases 8 envelop the emitter region 6.

In the primary application to semiconductor-component testers and handlers, clean-dry-air is most appropriately used for this purge gas.

Although the generic electrode arrangements of FIGS. 1*a* and 1*b* show single ionizing assemblies, pairs of positive/negative emitter assemblies 1 in accordance with the invention can be used in dc ionizers, and both electrodes 2, 3 can be corona emitters. Also, arrays of emitter assemblies 1 are commonly used. Typical arrays are illustrated in the remaining disclosures, but should not be construed as limiting the design of the ionizer.

PURGING OF AC STATIC ELIMINATORS

Figures 2, 2A:
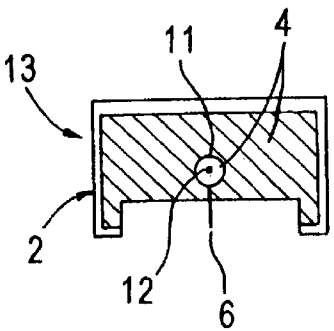
FIGS. 2*a*–1, 2*a*–2 show a gas-purged ac static bar in a nitrogen environment in accordance with the invention.
Figures 1, 2A:
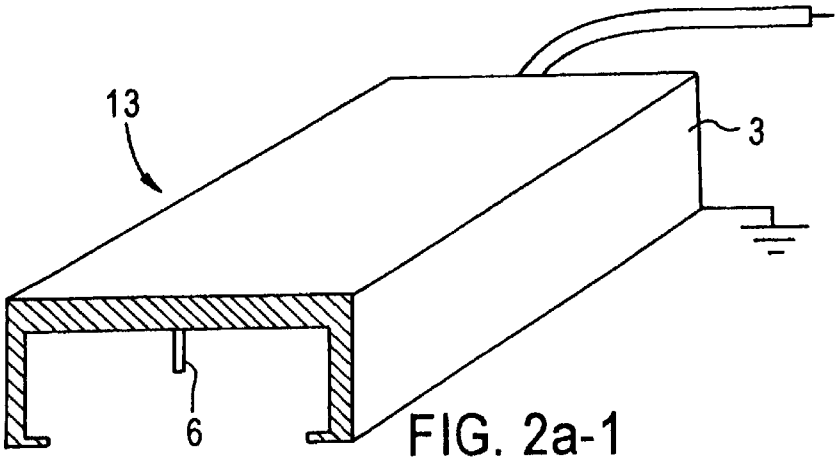
Figure 2A:
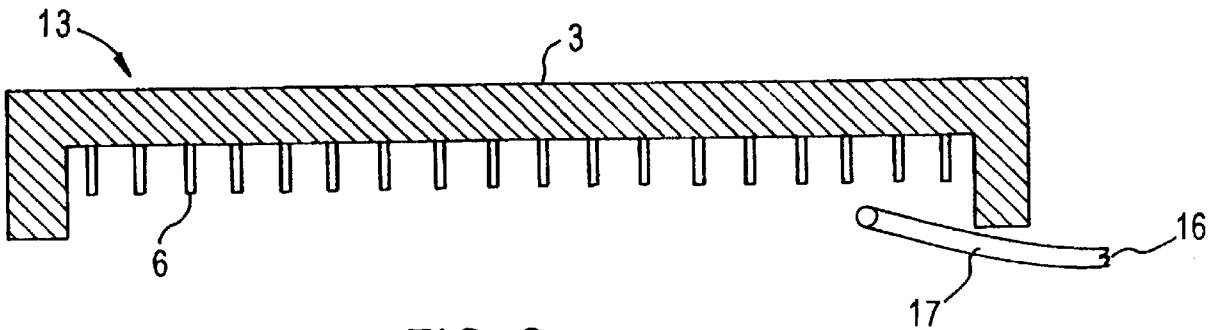
Figure 2B:
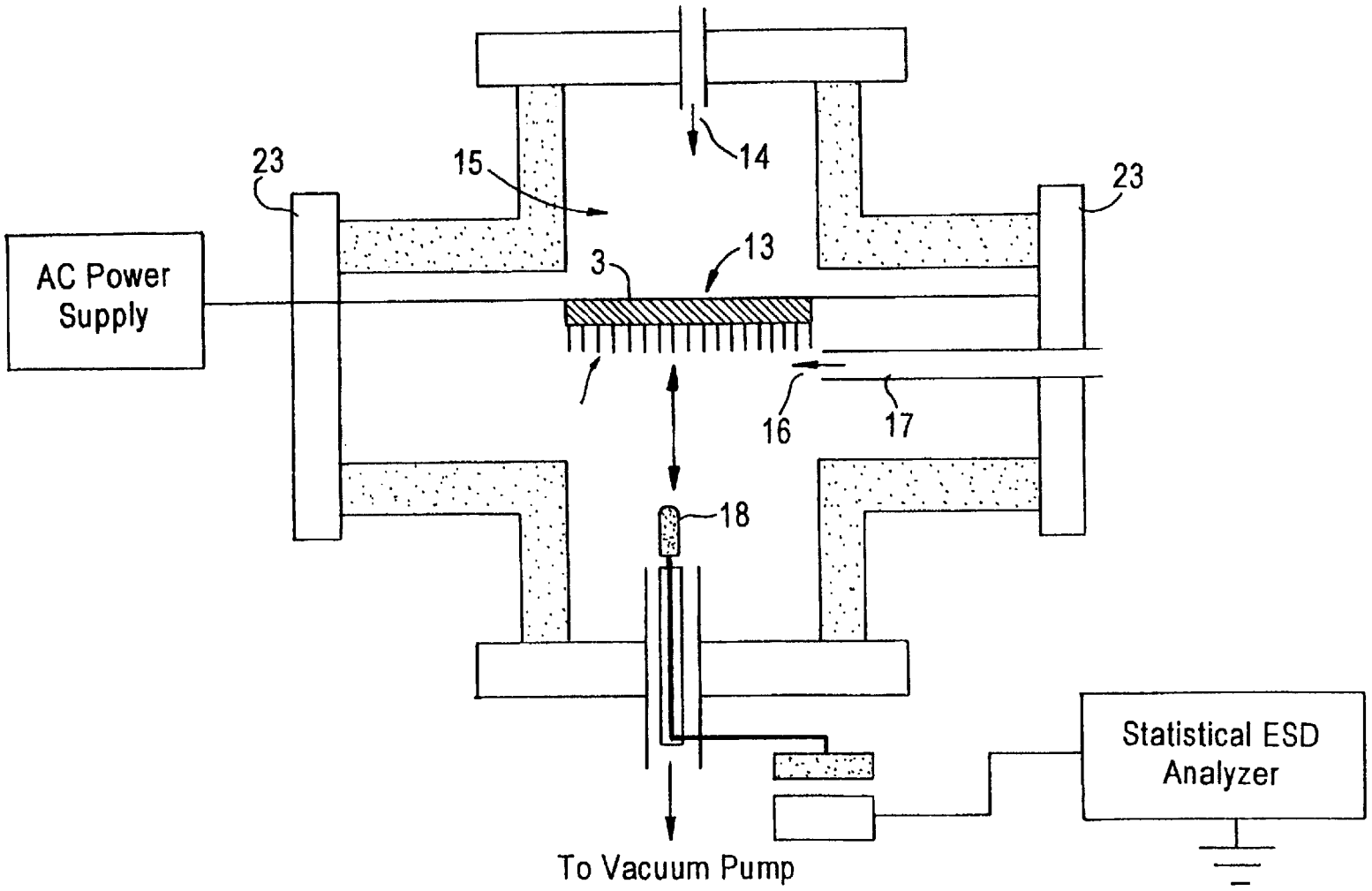
FIG. 2*b* is an illustration of a test arrangement for the ac static bar of FIG. 2*a;*

A commercially available ac static eliminator 13 can be purged with a small quantity of clean-dry-air to stabilize and eliminate the imbalance voltage in accordance with the present invention. The electrode construction is illustrated in FIG. 2*a* and the arrangement for tests is schematically depicted in FIG. 2*b*. The corona electrode set, operating at 60 Hz ac, consists of 18 needle-type emitters 6 within a grounded electrode casing 2. The needle electrodes 6 are capacitively-coupled through a metal ring 11 to the high voltage wire 12 in an insulation system within the grounded electrode casing 2. The ionizer is operated with ac voltages from 0 to 16 kV peak-to-peak applied to the wire 12.

The ionizer 13 is enclosed in an environmental chamber 15 maintained at atmospheric pressure as depicted in FIG. 2*b*. The volumetric flow rate 14 and temperature for nitrogen in the chamber ranged from 6000 to 10000 ml/min and from −10° to 60° C., respectively. Clean-dry-air (0 to 200 ml/min) was injected into the ionizer at 16 to determine its influence on the charge decay and steady-state balance condition. The nitrogen was introduced to the aluminum casing of the ionizer 13 through a PTFE tube 17 and generally flooded the gap between the emitters 6 and casing 3 (see FIG. 2*a*). Measurements of charge decay time and charge imbalance were secured using a half-sphere, conductive probe 18 located about 6 cm downstream from the ionizer 13.

Charge decay time is the time required for a 1000 V potential on the probe 18 to be reduced to 100 V. The charge on the probe is proportional to the potential and will have negative or positive polarity depending on the potential. For example, a negative charge decay time is the time required for positive carriers in the gas stream to neutralize a probe initially charged to −1000 V. If the potential on the probe is allowed to float after grounding, it will reach a steady potential or residual charge level. This steady state level is called the charge imbalance, residual potential, or unbalance condition.

Figure 3:
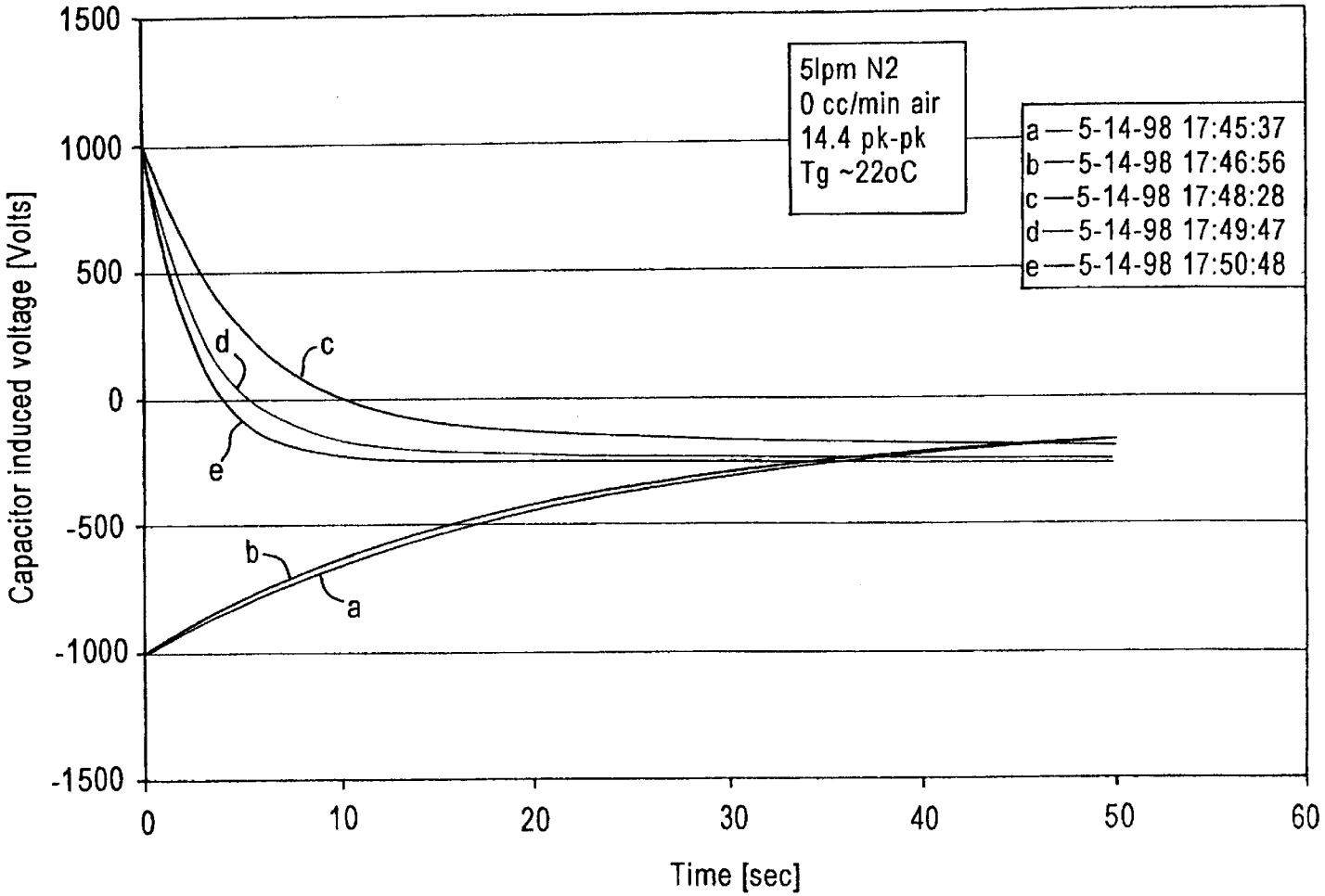
FIGS. 3–6 are graphs of results from tests conducted with the ac static bar.

As the remaining traces of air are removed from the corona emitter region 6 to create a nitrogen environment, the time required for neutralization of a positive initial charge decreases while it remains relatively constant for a negative initial charge (see FIG. 3 and increasing time a–e). Shorter positive charge decay times in this instance result from the replacement of negative ions (formed from electron attachment) with higher mobility free electrons.

Figure 4:
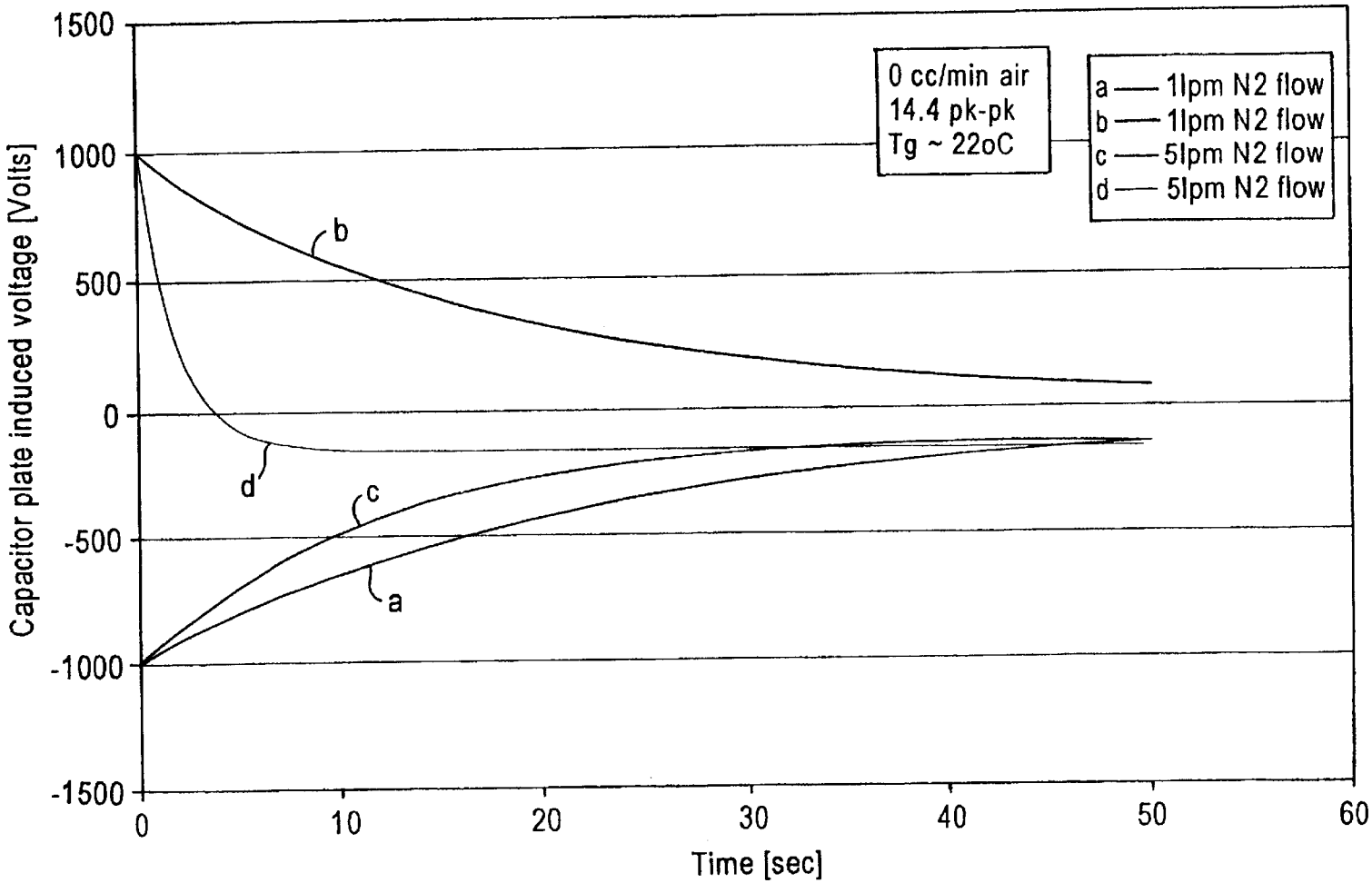

Increasing gas flow 14 by the ionizer 13 moves more carriers to the probe region 18 and reduces the charge decay times for positive and negative polarity charge accumulations. The effect is significantly greater for the negative (free electron) carriers (see FIG. 4).

Figure 5:
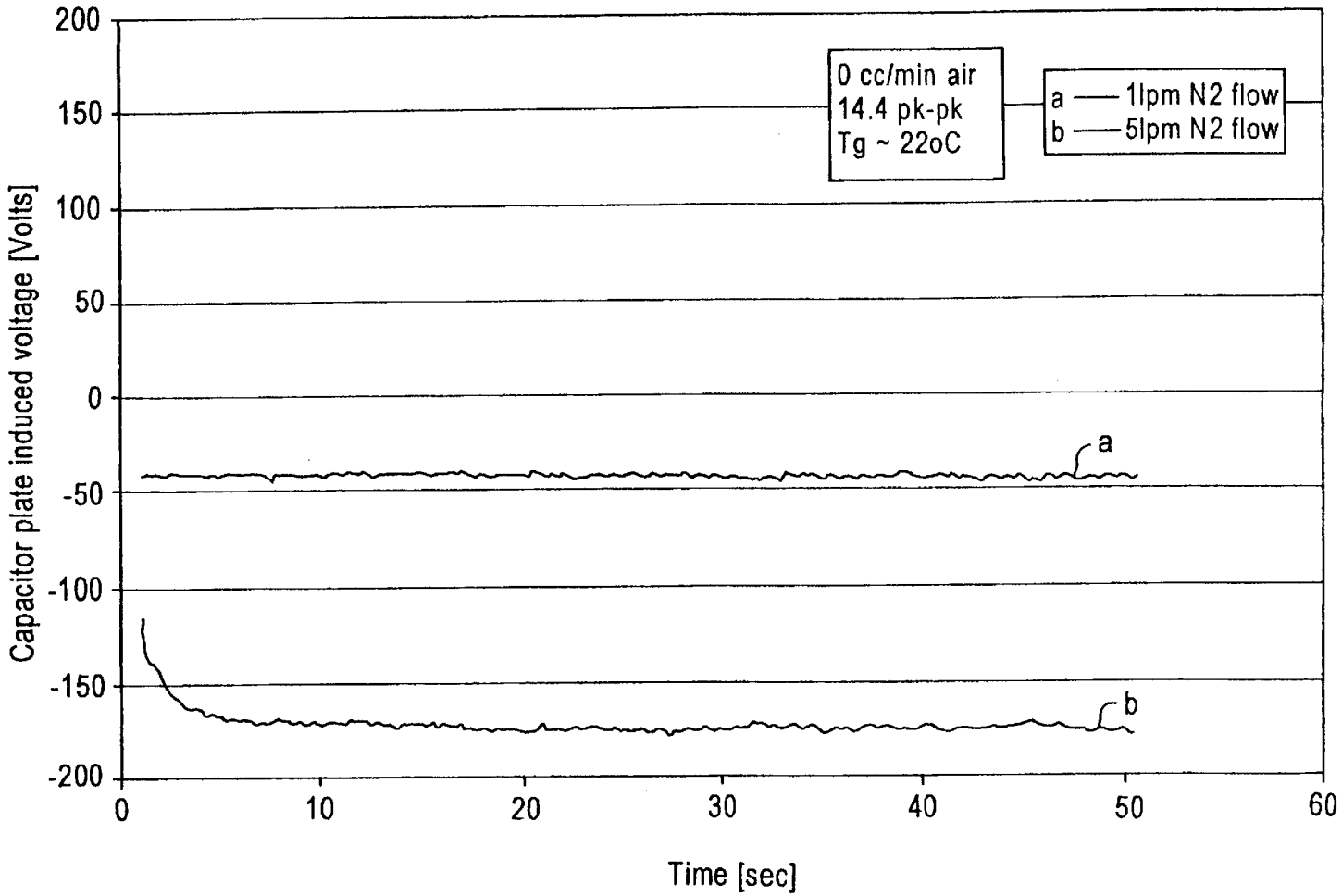

Increases in gas flow rate 14 increase the negative residual potential on the probe 18 to be neutralized (see FIG. 5).

Figure 6:
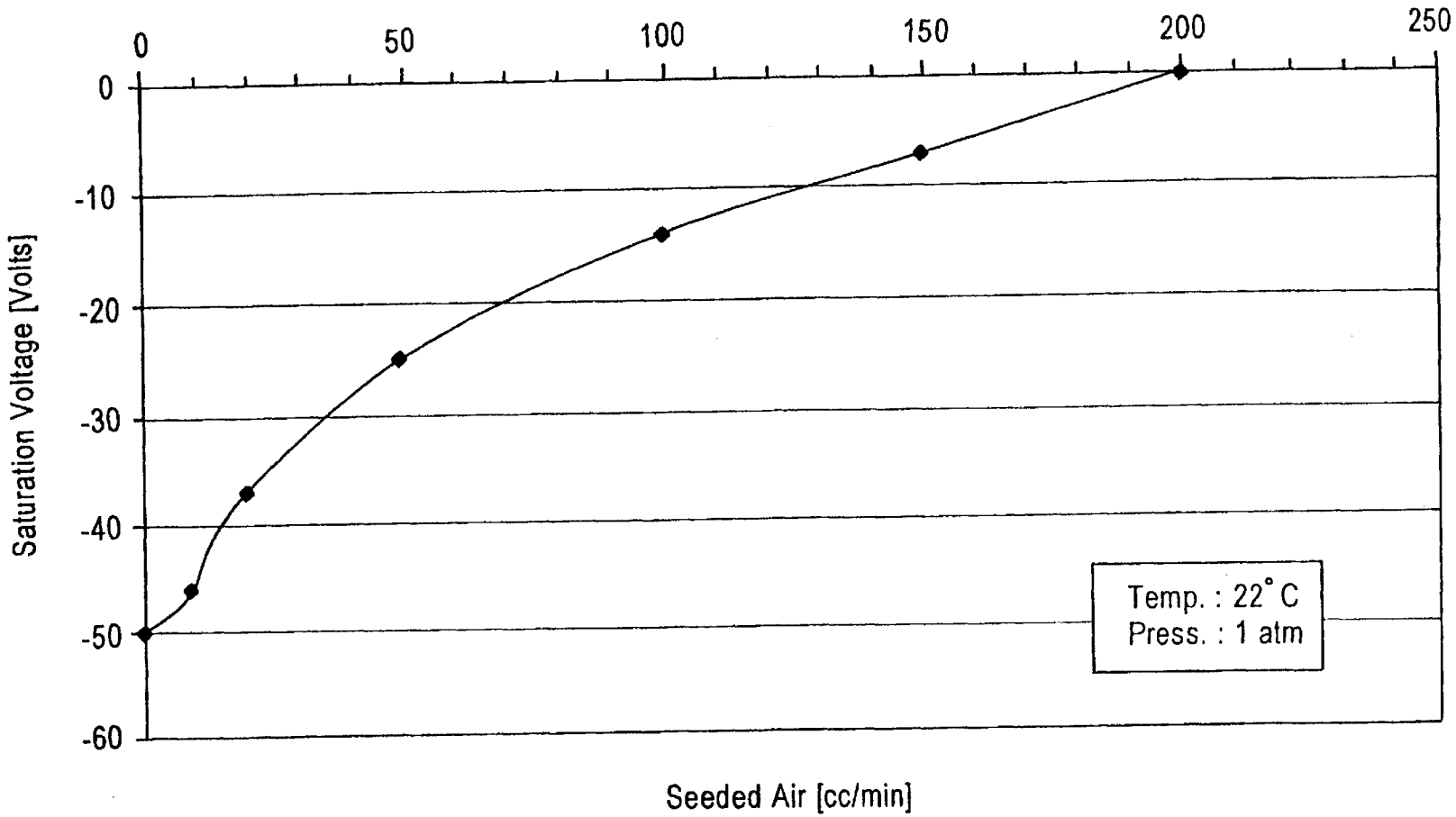

The injection of small quantities of clean-dry-air into the bar 16 in the manner described above will reduce the residual voltage on the probe 18. The dependence of saturation (residual) voltage on seeded air within ionizer bar 16 is shown in FIG. 6. Under steady-state conditions, the potential on the probe 18 is positive in clean-dry-air and negative in a nitrogen environment. Although their remains a small positive bias in the balance voltage in the air stabilized corona, this imbalance is sufficiently stable to be nulled by conventional balance techniques.

The quantity of gas injected into the ac ionizer 13, as described above, can be significantly reduced by controlled injection of air about the emitters. The flooding of the bar casing with air is only illustrative of the method.

PURGING OF A DC STATIC ELIMINATOR

Figure 7:
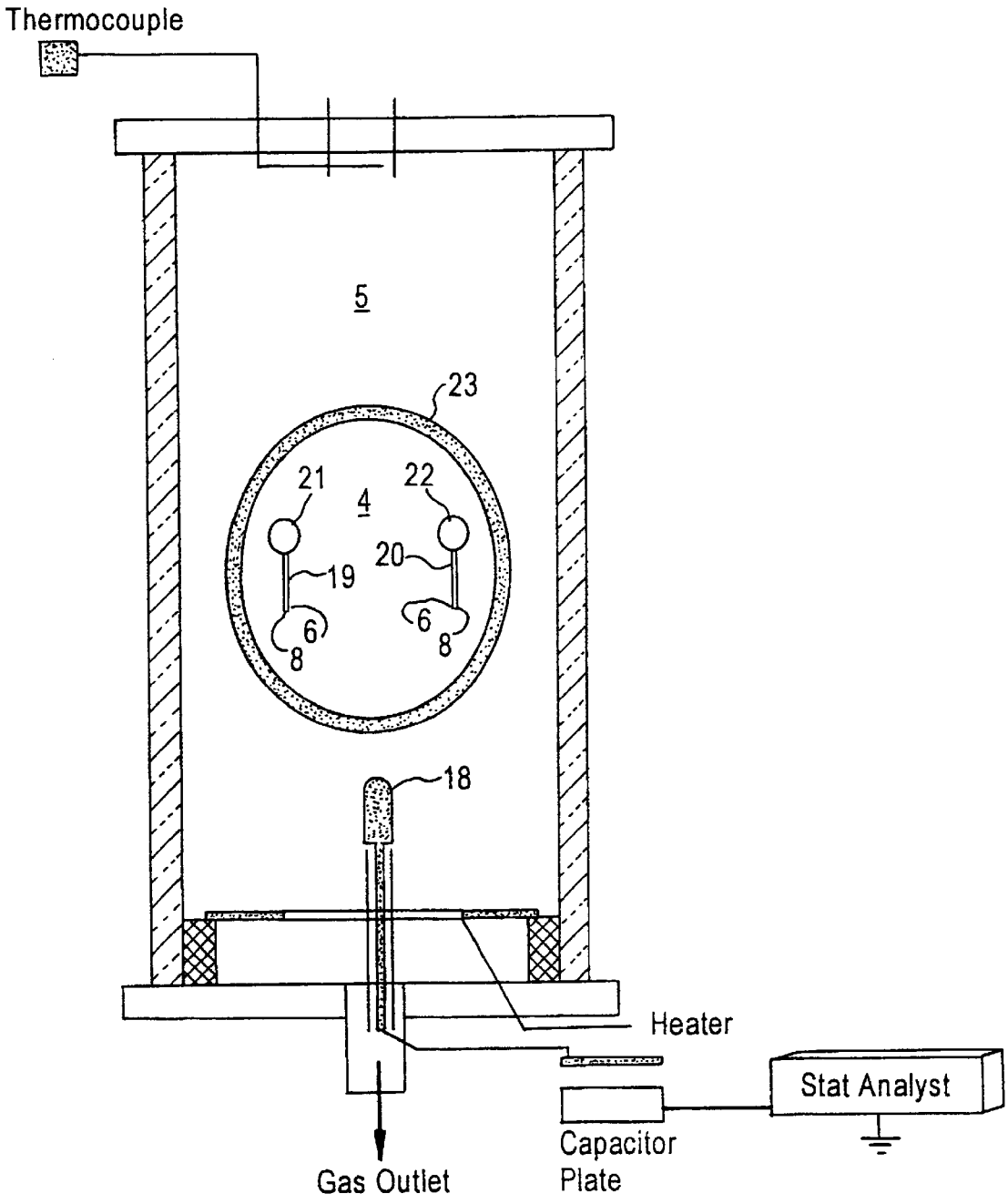
FIG. 7 is an illustration of a gas-purged hollow electrode ionizer-emitter pair.

FIG. 7 is an illustration of an ionizer constructed of parallel needles, one of negative polarity 19 and one of positive polarity 20. These needles 19, 20 are hollow and contain gas flow channels similar to those described in FIG. 1*a* and carry a gas from gas plenums 21 and 22, respectively. The electrodes 19, 20 are spaced apart and separated by environmental gases 5 that function as the insulation system 4. The dark circle in FIG. 7 is a schematically depicted structural component of the environmental chamber 23 (see FIG. 2*b*). The ionizer in FIG. 2*b* has emitters at 6 where the injected gases exit at 8.

Figure 8:
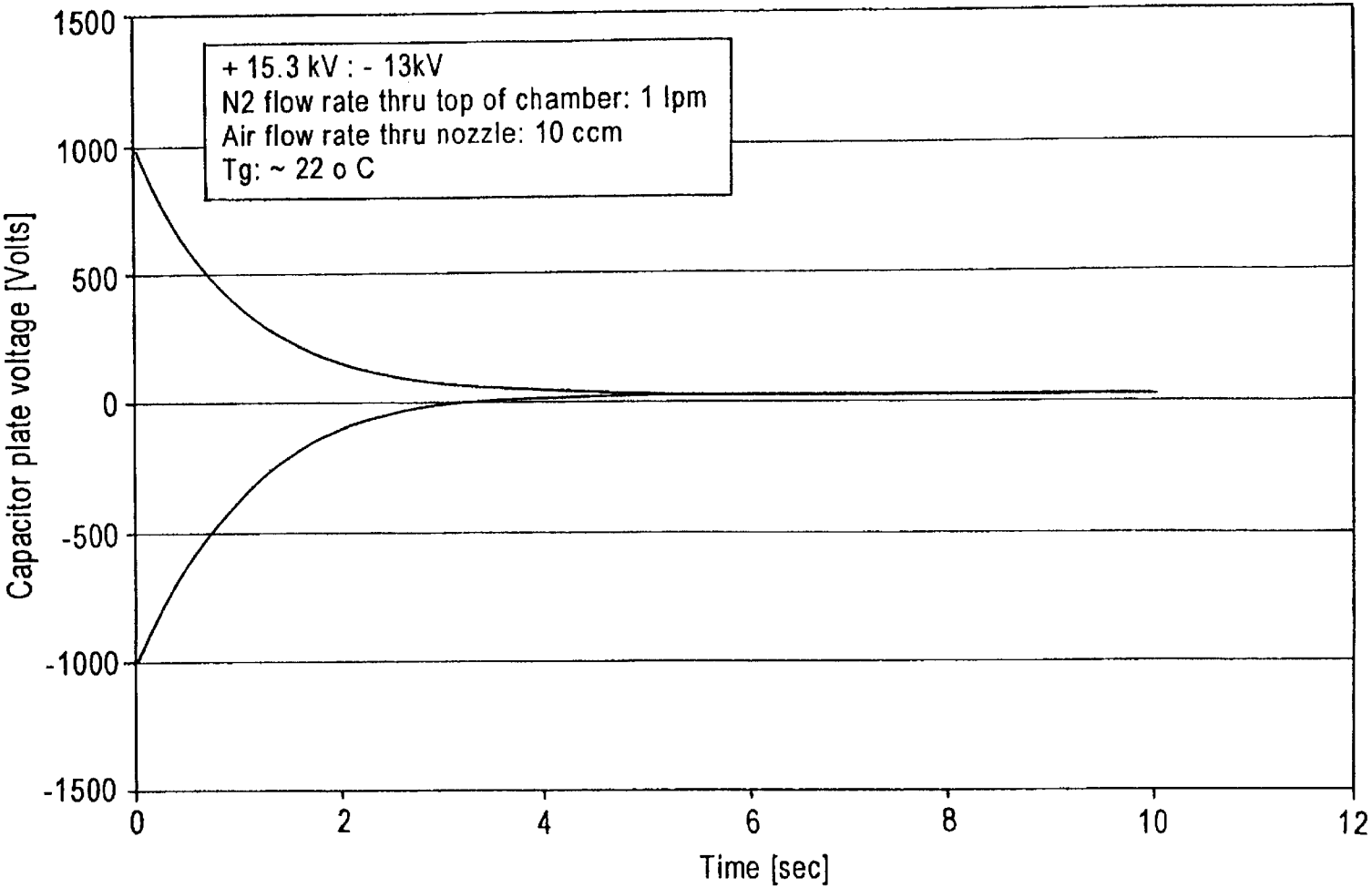
FIG. 8. shows the performance achieved with the gas-purged hollow electrode ionizer-emitter pair of FIG. 7.

Charge decay data is shown in FIG. 8 in a nitrogen environment 5 with air injected through the hollow emitters 6, 8. The results show similar charge decay times for positive and negative probe 18 potentials and a small positive residual potential, as obtained for the ac ionizer. As with the ac ionizer, the purpose for the purge gas 7, 8 is to add stabilizing, electron attaching components to, at least, the negative emitters in the gas stream.

The dc ionizers are especially suited for use in device and component handlers that are cooled with liquid nitrogen. The use of small quantities of electron attaching gases in the negative emitters and/or positive emitters is permissible in the testing environment. Small gas quantities are desirable so that the introduced gases are at thermal equilibrium with devices under test. Further, the gases introduced into the emitter region must be clean and dry to prevent freezing and contaminant buildup on the emitters, especially at low temperature. The emitters and gas flow are directed downstream towards objects to be neutralized and parallel to conveying gases present in the test area.

The volumetric flow of gas needed to stabilize a corona discharge will depend on the purity of the environment before and after injection of gas. The corona will be stabilized when the concentration of electron attaching gases is about 0.5% in front of the emitter. In purer gases, any injected gas will add to the electron attaching component towards the 0.5% goal. In small chambers with circulating flow the ambient level of electron attaching components may be increased sufficiently to stabilize corona with much lower injection rates than in the single pass case.

Corona induced gas flows within 1 mm of the emitter are near 20 m/s. Gas injections into this induced gas, as it is carried into a free stream, will produce the negative ions necessary to stabilize the corona. An injection rate of about 20 cm 3/min for each needle-type emitter will provide the necessary carriers for negative-ion formation at higher gas flows. Typical ionizing air blowers, where the exit velocity is about 2 m/s, or chambers with fan-driven flows will need only about 0.005% additions of electron attaching gases to the total flow, when the gases are injected through and around the emitters.

The air injection rate in FIG. 8 for a single emitter is near 1% and shows full stabilization in a single-pass chamber. The superficial velocity in the chamber is about 1% the superficial velocity used in blowers. Since air contains 20% oxygen, the electron attaching component is 0.2% or 0.002% when referred to typical gas velocities from blowers.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A method of achieving static neutralization in a gaseous environment that does not have electron attaching components where the mobility of corona generated positive and negative carrier species change over time, comprising the step of:

injecting a predetermined quantity of electron attaching gas in close proximity to a corona electrode disposed within the gaseous environment.

2. The method of claim 1, wherein said injecting step enables negative ions to form around and stabilize the corona.

3. The method of claim 2, wherein said injected gas is caused to flow around an emitter region and between the conductive or a semiconductive corona electrode and a conductive or semiconductive counter electrode.

4. The method of claim 3, wherein the injection gas entirely surrounds the corona electrode.

5. The method of claim 3, wherein both the corona electrode and the counter electrode are corona emitters.

6. The method of claim 1, wherein said gas is clear, dry air and said method is used within one of a semiconductor component tester and handler.

7. The method of claim 1, wherein an environment in which the ionizer is placed is substantially nitrogen or a noble gas.

8. The method of claim 7, wherein the electron-attaching gas is placed less than 5 mm from the corona electrode.

9. A static neutralizer for use in an ionizer, comprising:

(a) a pair of electrodes between which a potential voltage difference is applied, at least one said electrode being a conductive or semiconductive corona electrode, said pair of electrodes being placed in a gaseous environment that does not have electron attaching components; and (b) means for injecting a predetermined quantity of an electron attaching gas in proximity of a corona formed at an emitter region of the electrodes to thereby form negative ions and stabilize the corona.

10. The neutralizer of claim 9, wherein a space between the electrodes is filled with an insulating material.

11. The neutralizer of claim 10, wherein said pair of electrodes surrounded by said insulating material is placed in the gaseous environment.

12. The neutralizer of claim 11, wherein said gaseous environment is nitrogen.

13. The neutralizer of claim 9, wherein said electrodes form a hollow emitter assembly between which electrodes the gas is injected.

14. The neutralizer of claim 9, wherein said electrodes form a needle cavity assembly wherein a gas injection channel surrounds the corona electrode.

15. The neutralizer of claim 9, wherein said electrodes are formed as a corona electrode set having a plurality of needle type emitters mounted within a grounded electrode casing, said needle electrodes each being capacitively coupled through a metal ring to a high voltage wire in an installation system with the grounded electrode casing.

16. A static neutralizer for use with an ionizer housed in an environmental chamber, comprising:

means for injecting a noble gas into said environmental chamber;

a pair of electrodes between which a potential voltage difference is applied, at least one of said electrodes being a conductive or semi-conductive corona electrode; and means for injecting a predetermined quantity of an electron attaching gas in proximity of a corona formed at an emitter region of the electrodes to thereby form negative ions and stabilize the corona.

17. The neutralizer of claim 16, wherein said noble gas is nitrogen.

18. The neutralizer of claim 16, wherein a space between the electrodes is filled with an insulating material.

19. The neutralizer of claim 16, wherein said electrodes form a hollow emitter assembly between which the electron attaching gas is injected.

20. The neutralizer of claim 16, wherein said electrodes form a needle cavity assembly and wherein a gas injection channel surrounds the corona electrode for injecting the electron attaching gas.

* * * * *